US008435076B2

(12) United States Patent
Zhu

(10) Patent No.: US 8,435,076 B2
(45) Date of Patent: May 7, 2013

(54) LOW PROFILE ELECTRICAL CONNECTOR

(75) Inventor: Yu Zhu, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 29 days.

(21) Appl. No.: 13/109,022

(22) Filed: May 17, 2011

(65) Prior Publication Data

US 2012/0015558 A1 Jan. 19, 2012

(51) Int. Cl.
*H01R 13/40* (2006.01)

(52) U.S. Cl.
USPC ..... 439/625

(58) Field of Classification Search ..... 439/625, 439/627, 74, 65, 357, 66, 67, 862
See application file for complete search history.

(56) References Cited

U.S. PATENT DOCUMENTS 2,472,604 A * 6/1949 McDonald, Jr. ..... 338/198
6,692,266 B2 * 2/2004 Hashiguchi et al. ..... 439/74
7,448,882 B2 * 11/2008 Yoshida ..... 439/81
7,575,468 B2 * 8/2009 Chien et al. ..... 439/500
7,651,344 B2 * 1/2010 Wu ..... 439/80
7,802,994 B1 * 9/2010 Chen et al. ..... 439/65
7,946,888 B2 * 5/2011 Wu et al. ..... 439/626
8,079,875 B2 * 12/2011 Ho ..... 439/627
2001/0044234 A1 * 11/2001 Lam et al. ..... 439/625
2009/0170374 A1 * 7/2009 Chu et al. ..... 439/627

* cited by examiner

*Primary Examiner* — Jean F Duverne
(74) *Attorney, Agent, or Firm* — Wei Te Chung; Ming Chieh Chang

(57) ABSTRACT

An electrical connector includes an insulative housing and a terminal retained in the insulative housing. The insulative housing defines a mating surface and a mounting surface opposite to the mating surface, a pair of first side faces connecting with the mating face and the mounting face. A receiving room penetrates through the pair of first side faces and a through hole runs through the mating face and communicates with the receiving room. The terminal includes a mating board of frame shape received in the receiving room and soldering legs bending from the mating board to expose to the mounting face. The mating board has an open therein. Two spiral mating arms extend oppositely from opposite inside edges of the opening of the mating board with free ends thereof aligned with the through hole.

8 Claims, 6 Drawing Sheets

LOW PROFILE ELECTRICAL CONNECTOR

FIELD OF THE INVENTION

The present invention generally relates to an electrical connector, and more particularly to an electrical connector with a low profile.

DESCRIPTION OF PRIOR ART

Conventionally, an electrical connector comprises an insulative housing and a number of terminals received in the insulative housing. The electrical connector can further comprise a pair of board locks secured at two sides of the housing for mounting the electrical connector onto a printed circuit board (PCB) and a shell for preventing EMI. In recent years, with the ever-improving miniaturization and multifunction of consumer electronic products, such as mobile phones, digital cameras and the like, a large quantity of internal components mounted in the consumer electronic products are designed to be much smaller and thinner.

Hence, an improved electrical connector is highly desired to overcome the aforementioned problems.

SUMMARY OF THE INVENTION

The present invention provides an electrical connector including an insulative housing and a terminal retained in the insulative housing. The insulative housing defines a mating surface and a mounting surface opposite to the mating surface, a pair of first side faces connecting with the mating face and the mounting face. A receiving room penetrates through the pair of first side faces and a through hole runs through the mating face and communicates with the receiving room. The terminal includes a mating board of frame shape received in the receiving room and soldering legs bending from the mating board to expose to the mounting face. The mating board has an open therein. Two spiral mating arms extend oppositely from opposite inside edges of the opening of the mating board with free ends thereof aligned with the through hole.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Referring to FIG. 1~4, an electrical connector 100 in accordance with the present invention adapted for being mounted on a printed circuit board (PCB, not shown), comprises an elongated insulative housing 1, one terminal 2 retained in the insulative housing 1 for mating with a mating terminal 200 of a mating connector (not shown).

Figure 1:
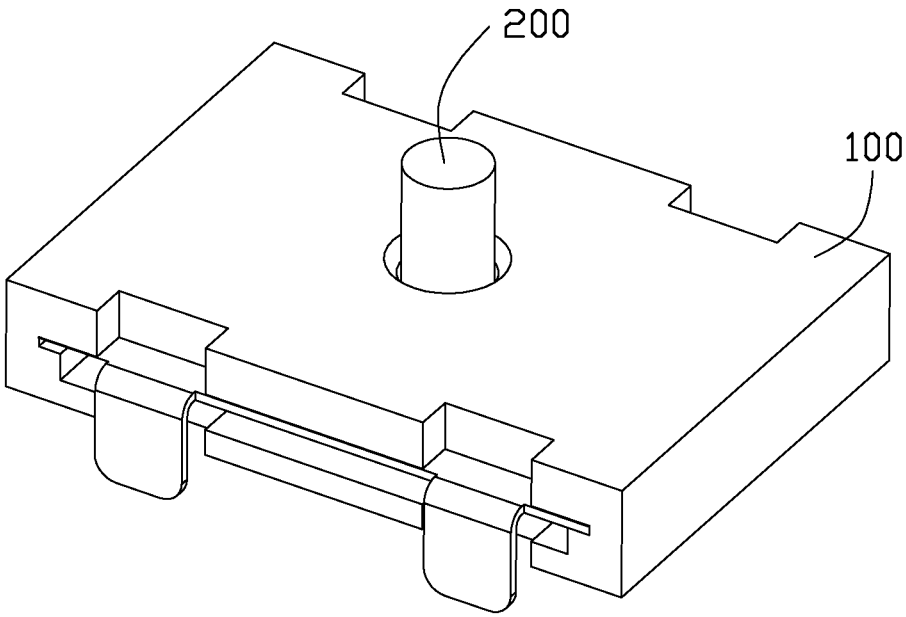
FIG. 1 is a perspective view of an electrical connector of an embodiment of the present invention, the connector being mated with a mating terminal.
Figure 2:
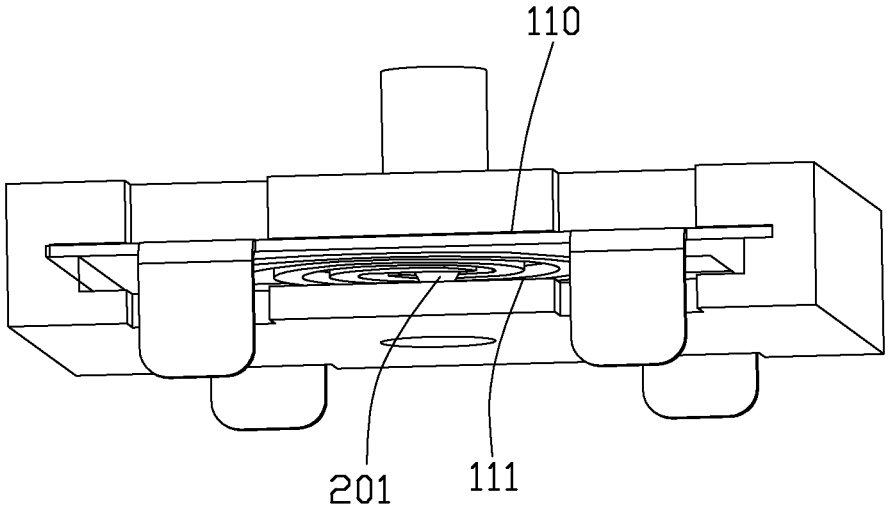
FIG. 2 is another perspective view of FIG. 1.
Figure 4:
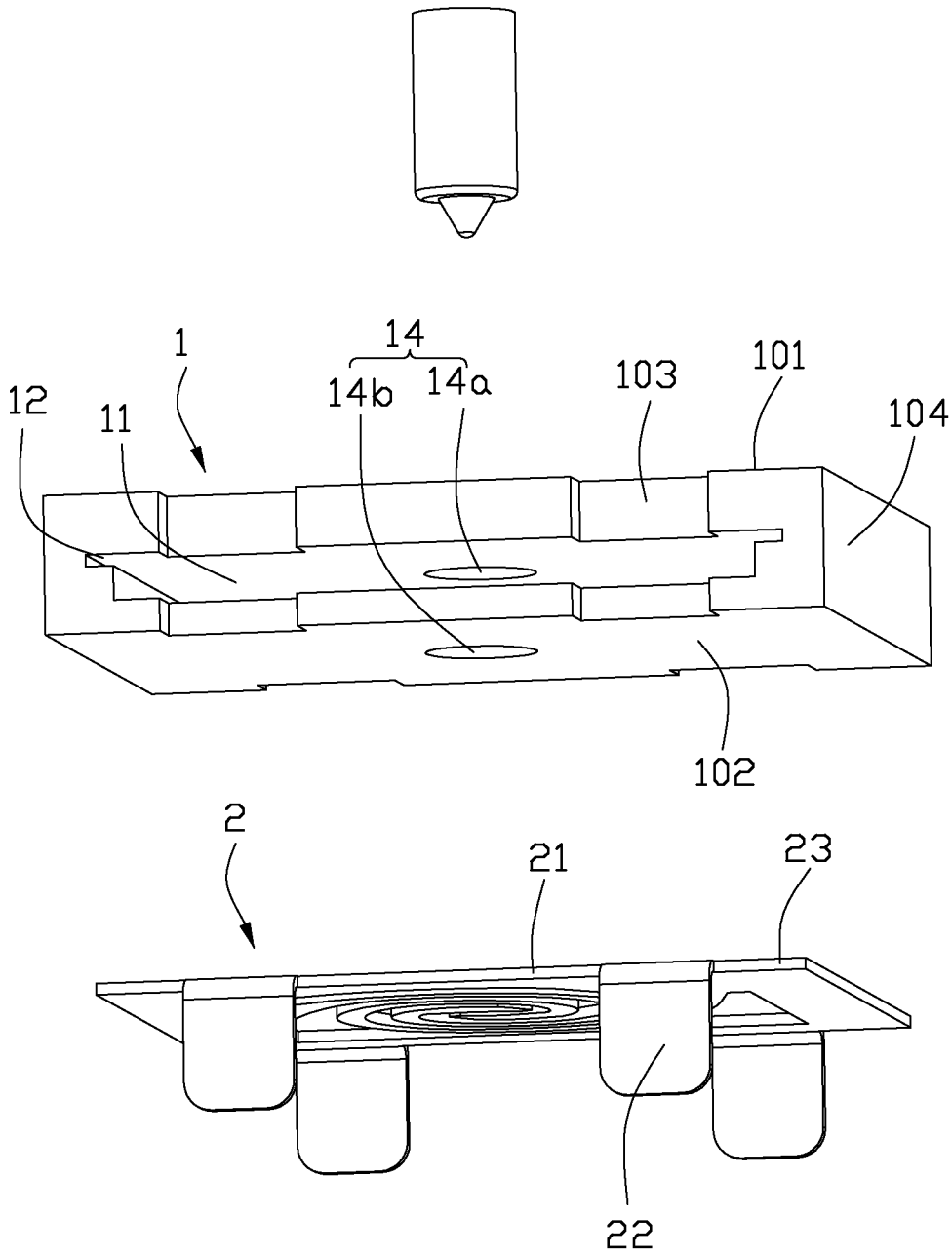
FIG. 4 is an exploded, perspective view of the electrical connector.

Referring to FIGS. 2 and 4, the insulative housing 1 is configured as flat board shape and defines a mating surface 101, a mounting surface 102 opposite to the mating surface 101, a pair of opposite first side faces 103 and a pair of opposite second side faces 104 perpendicular to the mating and mounting surfaces. A receiving room 11 penetrates through the first side faces 103 not through the second side faces 104 and is located between the mating surface 101 and the mounting surface 102. The receiving room 11 defines a first inner face 110 and a second inner face 111 opposite to the first inner face 110. Two retention slots 12 adapted for retaining the terminal 2 are formed in opposite side inner faces of the receiving room 11. Said retention slots 12 are located adjacent to the first inner face 110 and spaced apart from the second inner face 111. The terminal 2 comprises a mating board 21 received in the receiving room 11 and four soldering legs 22 extending perpendicularly from the mating board 21 beyond the mounting face 102. The mating board 21 is rectangular and has four right angles. The soldering legs 22 are spaced at a specified distance from the corresponding right angles to form two retention portions 23 at the two side edge of the mating board. Said retention portions 23 are retained in the corresponding retention slots 12 so that the terminal 2 is assembled to the insulative housing 1 from one of the first side faces 103. The soldering legs 22 are located in a same plane with the mating board 21 before assembling of the terminal 2 to the housing 1 and then the soldering legs are perpendicularly bent after the retention portions are completely retained in the slots. The mating board 21 of the terminal 2 abuts against the first inner face 110 and is spaced at a specified distance from the second inner face 111. The first and second inner faces 110, 111 are parallel to the mating surface 101. A cylindrical through hole 14*a*, 14*b* penetrates through the mating surface 101 and the mounting surface 102 and communicates with the receiving room 11. The mating terminal 200 is inserted into the receiving room 11 through the through hole 14*a* so as to engage with the terminal 2.

Figure 5:
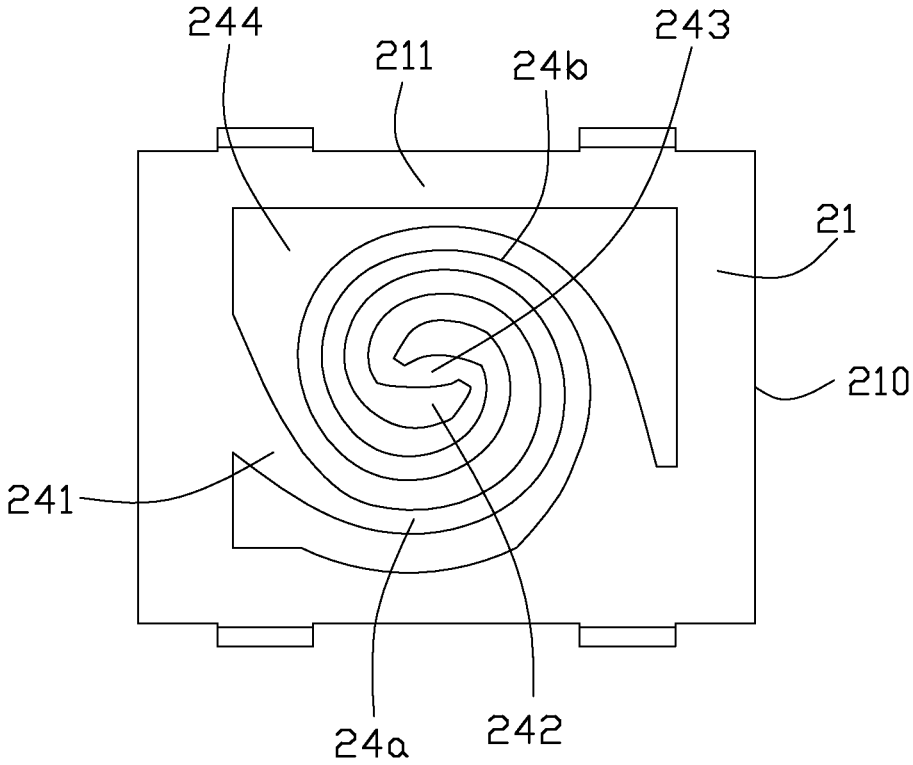
FIG. 5 is a top view of a terminal of the connector in FIG. 4.
Figure 6:
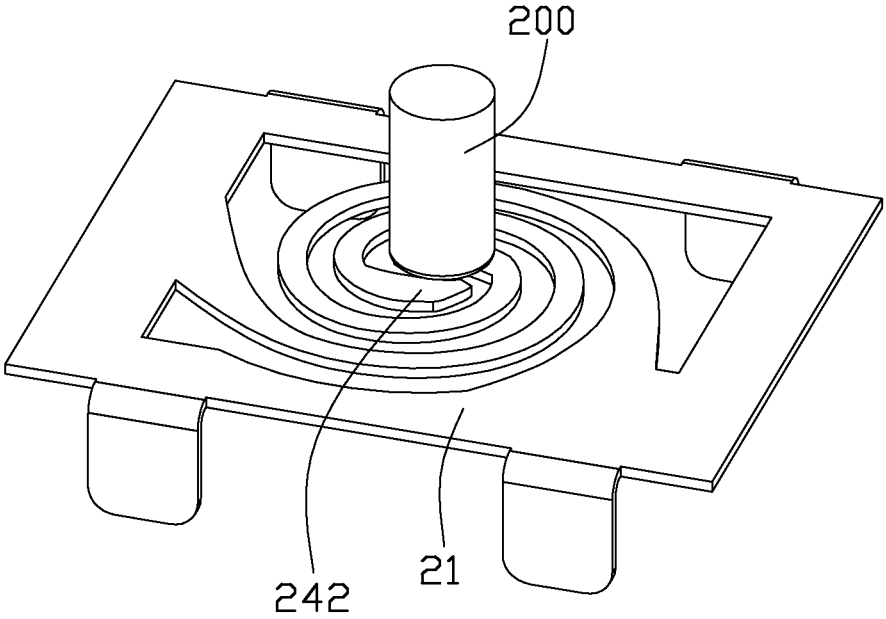
FIG. 6 is a perspective view of the terminal, which mates with a mating terminal.

Referring to FIGS. 5 and 6, the terminal 2 shall be introduced in detail. The mating board 21 of the terminal 2 is configured as frame shape. The mating board 21 has a large opening 244 therein. Two spiral mating arms 24*a*, 24*b* extend oppositely from opposite inside edges of the opening 244 of the mating board and said four soldering legs 22 extend perpendicularly from outside edges of the other two opposite sides 211 thereof. Four openings are formed in the first side faces 103 and penetrate through the mating and mounting surfaces 101, 102 to receive the corresponding soldering legs 22. The spiral mating arms 24*a*, 24*b* have free ends 242 with greater width and connection ends 241 with greater width which become narrower and narrower toward the corresponding free ends 242.

Figure 3:
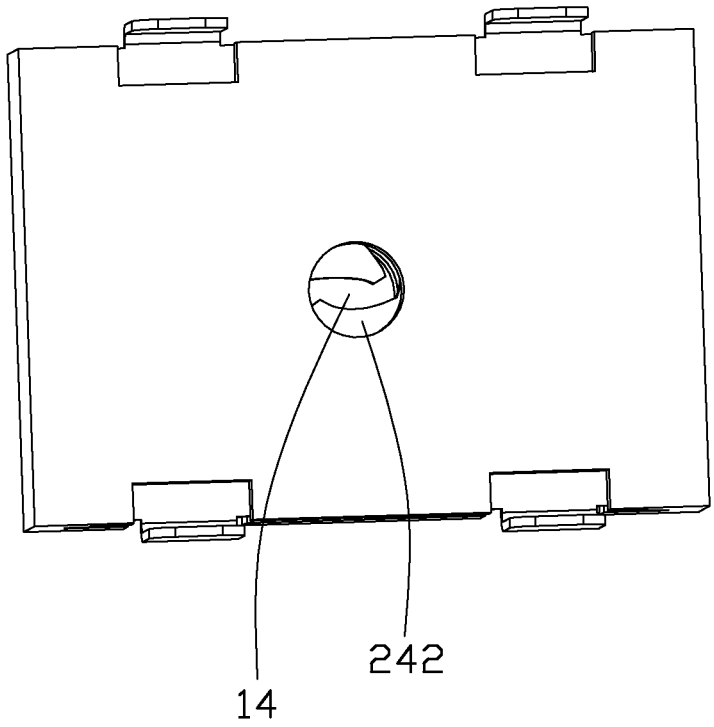
FIG. 3 is another perspective view of the electrical connector in FIG. 1, the mating terminal being removed.

Referring to FIG. 3, said two free ends 242 oppose to each other and are aligned with the through hole 14. Furthermore, the two free ends 242 are spaced apart from each other to form a gripping space 243. A tapered mating end 201 of the mating terminal 200 passes through the gripping space and is clamped by the two free ends 242 so that an electrical connection is formed between the terminal 2 and the mating terminal 200. When the two electrical connectors mate with each other, the tapered mating end 201 of the mating terminal 200 is located below the free ends 242 and received in the through hole 14*b* to facilitate insertion of the mating terminal 200.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. An electrical connector, comprising:

an insulative housing defining a mating surface and a mounting surface opposite to the mating surface, a pair of first side faces connecting with the mating face and the mounting face, a receiving room penetrating through the pair of first side faces and a through hole running through the mating face and communicating with the receiving room; and a metallic terminal comprising a mating board of frame shape received in the receiving room and soldering legs bending from the mating board to expose to the mounting face, the mating board having an opening therein;

wherein two spiral mating arms extend oppositely from opposite inside edges of the opening of the mating board with free ends thereof aligned with the through hole, the two spiral mating arms are formed from the mating board by direct-stamping;

wherein the soldering legs perpendicularly bend from two opposite first outside edges of the mating board near to four corners of the mating board; wherein a pair of retention portions is defined at two opposite second outside edges which connect with said two opposite first outside of the mating board, which are retained in a pair of retention slots defined on opposite inner faces of the receiving room.

2. The electrical connector as recited in claim 1, wherein the two mating arms are located in a same plane with the mating board, the two free ends oppose to each other.

3. The electrical connector as recited in claim 1, wherein the two mating arms have connection ends connecting with the mating board, which has a greater width than the free ends thereof.

4. An electrical connector comprising:

an insulative housing defining a mating surface and a mating hole running through the mating surface; and a metallic terminal retained in the insulating housing and comprising a board plane and a pair of spaced mating arms extending and located commonly in the board plane parallel to the mating surface with two free distal ends, said two free distal ends communicate and are aligned with the mating hole so as to grip a pole terminal of a mating connector which is inserted through the mating hole of the connector;

wherein the insulating housing defines a hole aligned with said mating hole at opposite side of the terminal so as to receive a free end of the pole terminals; wherein the insulating housing defines a receiving room receiving said terminal, the terminal are located adjacent to a first inside face of the receiving room parallel to and near to the mating surface while space from a second inside face opposite to the first inside face.

5. An electrical connector comprising:

an insulative housing defining a mating port facing toward an exterior in a first direction;

a conductive terminal disposed in the housing and defining two opposite resilient mating arms extending from different peripheral positions toward a center in an intermingled spiral while essentially mutually independently operational manner with two respective corresponding free ends located at the center and closely confronting each other in the mating port for receiving therebetween a plug which is adapted to be inserted into the mating port in a second direction opposite to said first direction;

wherein two opposite resilient mating arms are commonly located in a same plane perpendicular to said first direction; wherein the housing defines a planar face and the mating port extends through the planar face to communicate with the exterior; wherein the planar face is parallel to said same plane.

6. The electrical connector as claimed in claim 5, wherein said conductive terminal defines a frame structure and said mating arms extend from a periphery of the frame structure.

7. The electrical connector as claimed in claim 6, wherein said housing defines a passageway to receive the frame structure of the terminal, and said passageway extends in a third direction perpendicular to said first direction.

8. The electrical connector as claimed in claim 7, wherein said terminal defines a plurality of legs for mounting to a printed circuit board.

* * * * *